US005950742A

United States Patent [19]

Caraway

[11] Patent Number: 5,950,742

[45] Date of Patent: Sep. 14, 1999

[54] METHODS AND RELATED EQUIPMENT FOR ROTARY DRILLING

[75] Inventor: Douglas Caraway, Kingwood, Tex.

[73] Assignee: Camco International Inc., Houston, Tex.

[21] Appl. No.: 08/909,432

[22] Filed: Apr. 15, 1997

[51] Int. Cl.[6] ..... E21B 10/00; E21B 10/62

[52] U.S. Cl. ..... 175/57; 175/257; 175/374

[58] Field of Search ..... 175/57, 257, 309, 175/374, 425

[56] References Cited

U.S. PATENT DOCUMENTS

| | | | |
|---|---|---|---|
| 3,117,636 | 1/1964 | Wilcox et al. | 175/257 |
| 3,945,444 | 3/1976 | Knudson | 175/257 |
| 4,889,194 | 12/1989 | Danielsson | 175/331 |
| 5,052,502 | 10/1991 | Jurgens et al. | 175/257 |
| 5,590,726 | 1/1997 | Jarvela | 175/257 |

*Primary Examiner*—William Neuder
*Attorney, Agent, or Firm*—Fletcher, Yoder & Van Someren

[57] ABSTRACT

Methods and related equipment for drilling a wellbore in subterranean formations whereby a drill bit is attached to one end of a first conduit string, such as a casing string which is not usually used for drilling, and advancing the first conduit string and the drill bit into the subterranean formation to extend an existing wellbore, cleanout the wellbore or create a new lateral wellbore. This advancement is stopped and steps are taken to create a longitudinal opening through the drill bit. Thereafter, a second conduit string is advanced through the opening in the drill bit and into the subterranean formation to further extend, cleanout or create the lateral wellbore.

27 Claims, 3 Drawing Sheets

METHODS AND RELATED EQUIPMENT FOR ROTARY DRILLING

BACKGROUND OF THE INVENTION

1. Field of the Invention

The invention relates to rotary drill bits for drilling wellbores in subsurface formations and, more particularly, to drill bits that can be left in the wellbore and drilled through, if needed to do so.

2. Description of Related Art

In the drilling of wellbores in subsurface formations it is common place to connect the drill bit to relatively heavy and thick-walled drill pipe that is rotated at the earth's surface by a rotary table or rotated within the wellbore by a downhole motor or turbine. When a particular section of the wellbore has been drilled, the drill pipe and the drill bit are recovered to the surface and a string of relatively thin-walled pipe, called casing, is set within the wellbore and cemented in place.

When drilling into relatively high pressure zones problems can occur when trying to reenter the wellbore with the casing string. Oftentimes in drilling in the Offshore Gulf Coast of the U.S.A., when the drill bit and the drill string breach a high pressure zone, the drilling operation may be ceased so that the operator can pump heavy drilling fluid into the wellbore to prevent the high-pressure fluids from the high pressure formation from rapidly rising to the surface. When the drilling has ceased, the wellbore tends to swell or slough or collapse, and removal of the drill string and the drill bit can be difficult and sometimes impossible. If the drill string can be removed, the reentry into the wellbore with the casing string can be very difficult and sometimes impossible, for the above reasons. All of these problems cause the drilling operation to be delayed, with hundreds of thousands of dollars in increased costs. Worst of all, if the drill bit cannot be removed then the wellbore must be abandoned or side-tracked.

There is a need for methods and related equipment that will allow the operator to drill through the high pressure zones, leave the drill bit in place if needed, and eliminate the need for a drill pipe removal and casing string tripping operation.

SUMMARY OF THE INVENTION

The present invention has been contemplated to overcome the foregoing deficiencies and meet the above described needs. In particular, the present invention comprises methods and related equipment for drilling a wellbore in subterranean formations. A drill bit is attached to one end of a first conduit string, such as a casing string, which is not usually used for drilling, and the first conduit string and the drill bit are advanced into the subterranean formation to extend or clean out an existing wellbore or create a new wellbore. This advancement is stopped and steps are taken to create a longitudinal opening through the drill bit or displace all or a portion of the drill bit. Thereafter, a second conduit string and a second drill bit are advanced through the opening in the drill bit and into the subterranean formation to further extend or create the wellbore.

With the present invention when the operator determines that a high pressure zone is to be breached, the drill string is removed and a specialized drill bit is attached to the casing string. The casing string is then used to drill the wellbore and breach the high pressure zone. In the event that the drilling operation is ceased, the casing string is already in place and does not have to be removed. The special drill bit does not need to be removed and so is left in the wellbore, and is then milled or drilled through, so that the drilling operation can be completed. The present invention can save the operator many thousands of dollars by eliminating the need for the drill pipe to be removed from the wellbore after the high pressure zone has been breached, as well as enabling the drilling operation to continued even if the drill bit becomes stuck in the wellbore.

DETAILED DESCRIPTION OF THE PREFERRED EMBODIMENTS

As described briefly above, the present invention relates to methods and related equipment for drilling a wellbore in subterranean formations. Specifically, a drill bit is attached to one end of a first conduit string, such as a casing string which is not usually used for drilling, and advanced into the subterranean formation to extend an existing wellbore, clean out a well or create a new wellbore. This advancement is stopped and steps are taken to create a longitudinal opening through the drill bit or displace all or a portion of the drill bit. Thereafter, a second conduit string and a second drill bit are advanced through the opening in the drill bit or past the displaced drill bit and into the subterranean formation to further extend or create the wellbore.

Figure 1:
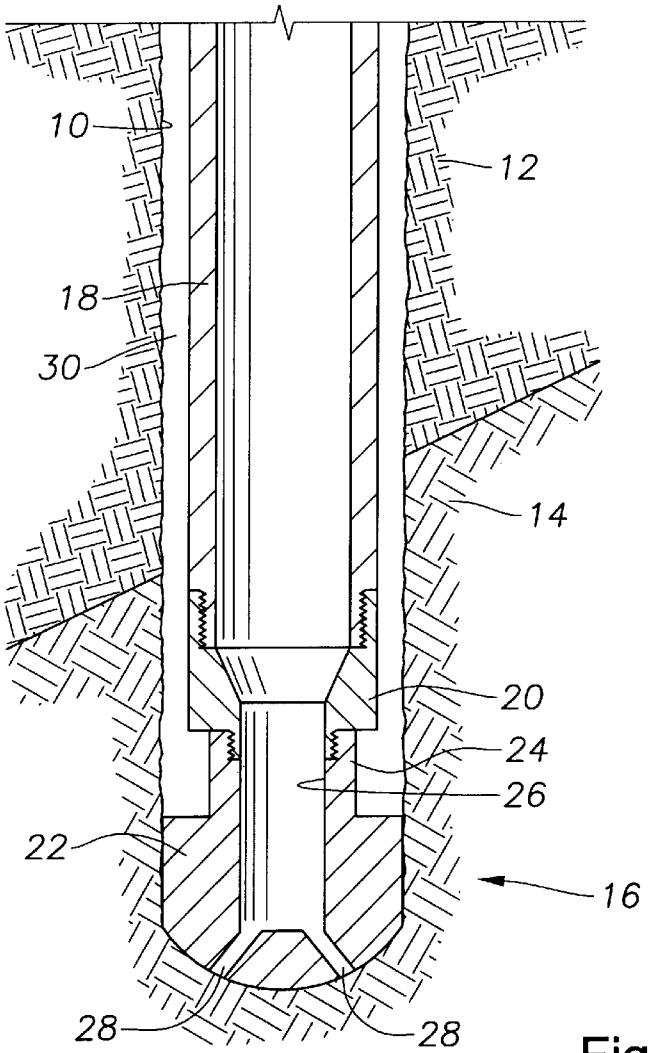
FIG. 1 is an elevational cross-sectioned view of one preferred embodiment of a drill bit of the present invention shown connected to a casing string within a wellbore.

To aid in the understanding of the present invention, reference is made to the accompanying drawings. FIG. 1 shows a wellbore 10 being drilled through a relatively low pressure zone 12 into a relatively high pressure zone 14. In this preferred embodiment, the drilling operator would have determined that the wellbore 10 was about to breach the high pressure zone 14, the drilling is stopped, and the conventional drill pipe and conventional drill bit (both not shown) are then removed from the wellbore 10. A new drill bit 16 is either directly threadedly connected to a casing string 18, or connected using a threaded adapter 20, as shown in FIG. 1, and then lowered into the wellbore 10. Since the casing 18 is not designed to take the torque and weight forces that drill pipe is designed to withstand, the casing 18 is only intended to drill a relatively short distance, such as from about 60 feet to about 200 feet, depending upon the depth of the wellbore and the hardness of the formation materials.

The drill bit 16 is rotated either by a top drive or a rotary table (both not shown), which are well known to those skilled in the art. Once the drill bit 16 has breached the high pressure zone 14, the advancement of the wellbore 10 can be continued for as long as desired, or the drilling operation can be ceased so that the casing 18 can be cemented in place, as is well known in the art.

When the advancement of the wellbore 10 is to be continued, either a longitudinal opening must be made within the drill bit 16 or all or a portion of the drill bit 16 must be displaced to enable the advancement of a new or second drill string through or past the drill bit 16. Leaving a drill bit within a wellbore has been something that operators have tried extremely hard to avoid. Further, opening a hole with a drill bit has been unthinkable because drill bit manufactures have strived to make the drill bits as robust, non-breakable and as hard as possible.

Figure 5:
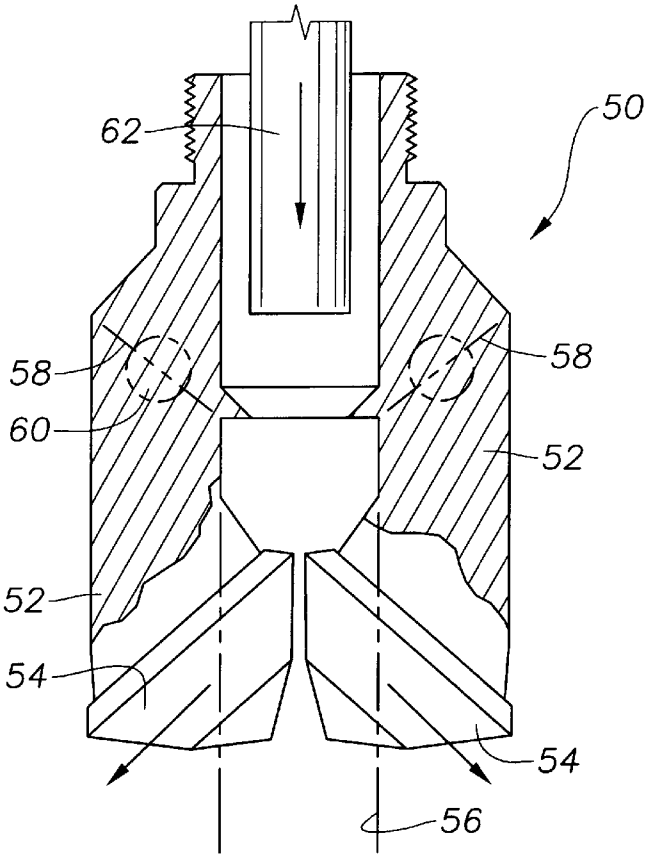
FIG. 5 is an elevational cross-sectioned view of an alternate preferred embodiment of a drill bit of the present invention, such as a rolling cutter rock bit.

The drill bit 16 can be a rolling cutter rock bit (as shown in FIG. 5) or a drag-type drill bit, as shown in FIG. 1. The present invention is not limited to the type of drill bit used, but for the following discussion a drag-type drill bit will be discussed in detail. The drill bit 16 of FIG. 1 comprises a bit body 22 machined from metal, usually steel, which may be hard faced. Alternatively the bit body 22, or a part thereof, may be molded from matrix material using a powder metallurgy process. The methods of manufacturing drill bits of this general type are well known in the art and will not be described in detail. A threaded steel shank 24 extends from the bit body 22 for interconnection to the adapter 20 or the casing string 18, as is well known to those skilled in the art.

The bit body 16 includes a plurality of cutting elements (not shown), which can be natural diamond particles, TSP, or preform cutting elements comprising a facing table of polycrystalline diamond or other superhard material bonded to a substrate of less hard material, such as cemented tungsten carbide. The cutting element may be bonded to a support post or stud which is received in a socket in the bit body 22 or the substrate itself may be of sufficient length that it may be directly received in a socket in the bit body 22.

The bit body 22 is formed with a central longitudinal passage 26 which communicates through subsidiary passages, ports and/or nozzles 28 mounted at the surface of the bit body 22. In known manner drilling fluid under pressure is delivered to the nozzles 22 through the internal passages and flows outwardly therethrough so that the drilling fluid flows upwardly through an annulus 30 between the casing string 18 and the surrounding formations 12 and 14.

The inventor hereof has determined that several different methods may be used to create the opening in the bit body 22 to enable the drilling operation to be continued therethrough. Such methods may employ drill bits with specialized features that create the opening or standard commercial drill bits. Further, such methods may employ one or more of the following described methods in combination with the standard or the special drill bits, as is desired.

Figure 2:
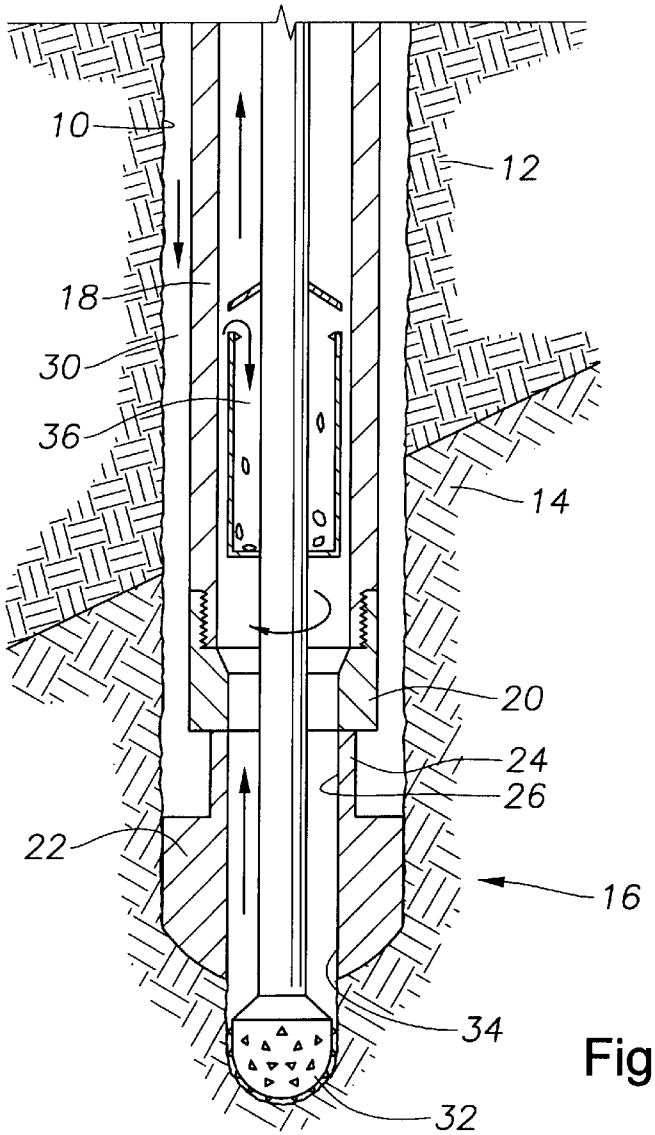
FIG. 2 is an elevational cross-sectioned view of a milling tool creating an opening in the drill bit of FIG. 1 in accordance with one preferred method of the present invention.
Figure 3:
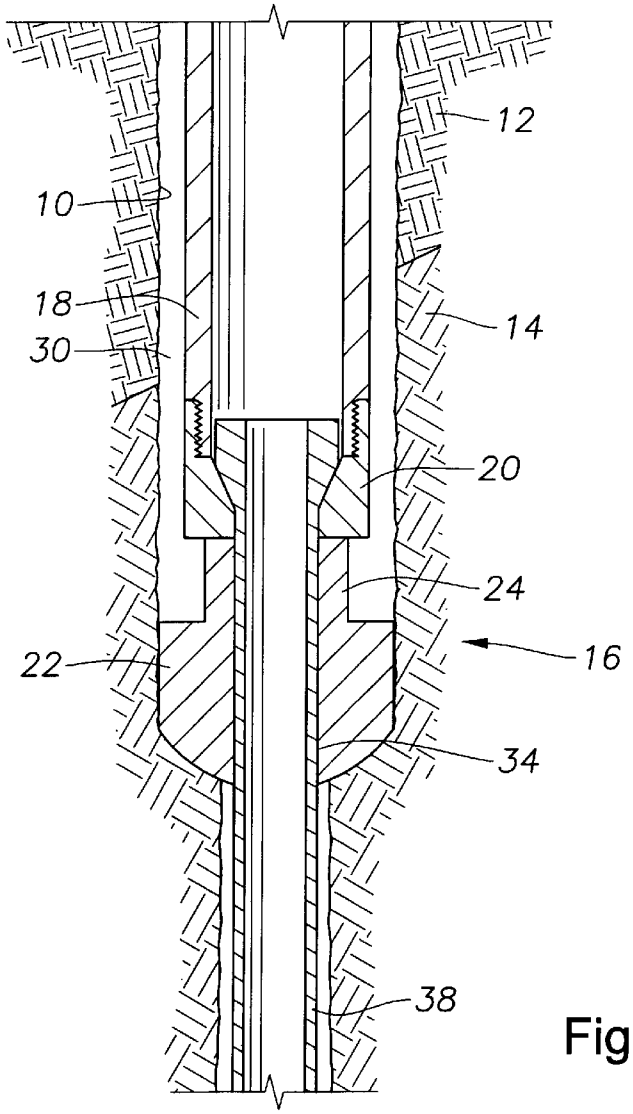
FIG. 3 is an elevational cross-sectioned view of a casing string set through the drill bit of FIG. 1 in accordance with one preferred method of the present invention.

For example, FIGS. 1–3 illustrate one preferred method, that will be described in detail below. Specifically, the drill bit 16 can be a standard commercially available steel body drag bit with PDC cutting elements, or preferably, the drill bit 16 has its bit body 22 formed from a relatively soft material such as mild steel, bronze, brass, ceramics, carbon-reinforced materials, or most preferably aluminum. Once the opening is to be created, a standard commercially available milling tool 32 is lowered into the casing 18 and into the bit body 22. The milling tool 32 is rotated to create an enlarged opening 34 through the bit body 22. Remnants of such milling operation, such as the cutting elements and portions of the bit body, are removed by having fluid pumped down the annulus 30 past the bit body 22 and up into the interior of the bit body 22 and the casing 18. A commercially available junk basket 36 is shown connected to a pipe string 38 that includes the milling tool 32, so that the remnants fall into the junk basket 36 for recovery to the earth's surface.

One should note that the cementing of the wellbore 10 need not wait until after the opening in the bit body 22 has been created, since the cement slurry can be pumped down the casing string 18, through the nozzles 28 of the drill bit 16 and into the annulus 30, as is well known to those skilled in the art.

When the drilling operation is to be continued, a new drill pipe with a new drill bit are lowered into the casing 18 and pass through the opening 34 in the first drill bit 16. Thereafter, the drilling continues as is desired. When the wellbore 10 is to be completed, a new casing string 40 can be landed within the casing 18 and the drill bit 16, and cemented in place, as shown in FIG. 3.

As described above, and as now can be understood, in the event that the drilling operation is ceased, the casing string is already in place and does not have to be removed, as in the past. The drill bit 16 does not need to be removed and so is left in the wellbore 10, and is then displaced or milled or drilled through, so that the drilling operation can be completed. Therefore, the present invention can save the operator many thousands of dollars by eliminating the need for the drill pipe to be removed from the wellbore after the high pressure zone has been breached, as well as enabling the drilling operation to continued even if the drill bit becomes stuck in the wellbore.

Figure 4:
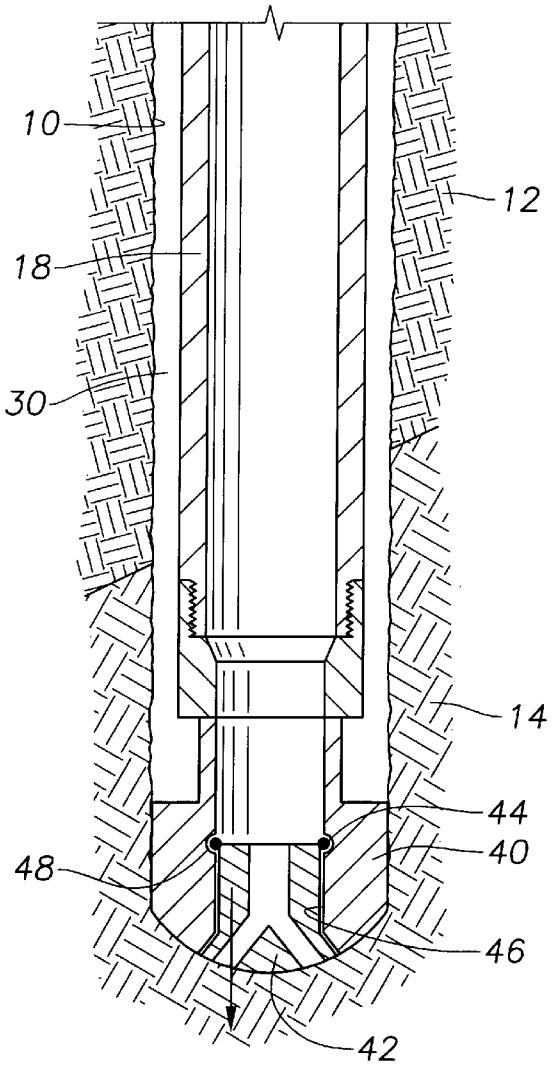
FIG. 4 is an elevational cross-sectioned view of an alternate preferred embodiment of a drill bit of the present invention shown connected to a casing string within a wellbore.

Now that the overall concepts of the present invention have been described, details will be provided for variations in the construction of the drill bit 16 and the methods of creating the opening 34 or displacing all or a portion of the drill bit 16. FIG. 4 shows a drill bit 40 with a section or portion thereof that is adapted to be removed, rather than being milled or drilled out, as described previously in relation to FIGS. 1–3. In the drill bit 40 a central face portion 42 is provided with means to keep it in place during the drilling operation and means to cause it to be removed as a single piece or preferably as several pieces, when the opening is to be created. The face portion 42 can be formed from the same material as the rest of the bit body or it can be formed from a softer material to assist in its removal and disintegration. The face portion 42 can be cylindrical in construction with one or more lugs or keys (not shown) to prevent its rotation during drilling, or preferably frustoconical in shape or with one or more facets to prevent its rotation.

Alternatively or in addition to the constructions noted above, as shown in FIG. 4, the face portion 42 includes one or more mechanisms, such as an annular ring 44 or bracket or pins, that holds the face portion 42 in place while drilling. When an opening 46 is to be created to permit the continued drilling therethrough, the face portion 42 is removed (as a single piece or as several pieces) by the application of fluid pressure to break the retention mechanism(s), such as the ring 44, application of heat to melt the retention mechanism, application of acid to disintegrate the retention mechanism, application of a solvent to dissolve the retention mechanism, and/or the application of mechanical force to shear the retention mechanism, such as by a weighed bar that is dropped into the wellbore and/or commercially available coiled tubing or wireline jars. Thereafter, a milling tool can be run through the bit 40 to enlarge the opening 46, if desired, and to ensure that the face portion 42 has been removed and/or to ensure that the face portion 42 has been broken into pieces so that they can be circulated out and into a junk basket for removal from the wellbore.

Alternatively, if the face portion 42 is made from several pieces, the face portion 42 may include glue or solder or other binding agents that holds the face portion 42 together as a unit and/or that holds the face portion 42 in the drill bit 40, alone or in addition to the retention mechanism 44, such as a ring, bracket or pins. In this case, the face portion 42 will be removed from the drill bit 40 and/or broken into several pieces by the application of fluid pressure to break the binding agent(s), application of heat to melt the binding agent(s), application of acid to disintegrate the binding agent(s), application of solvent to dissolve the binding agent(s), and/or the application of mechanical force to release the binding agent(s), such as by a dropped weighed bar or commercially available coiled tubing or wireline jars.

In another preferred embodiment, the drill bit 40 will not have a separate defined removable portion, and as such either the entire drill bit body 22 itself will be drilled out, broken off or broken into pieces, or a selected portion of the drill bit body 22, such as the face portion and/or the shank 24, will be drilled out or broken off.

In another preferred embodiment, the interior of the drill bit 40 includes zones of induced weakness to assist in the breakage, removal and/or displacement of the portion of the drill bit that is to be removed or displaced to clear a pathway for the second drill bit to pass therethrough or therepast. Such zones of weakness comprise lines of perforations, etchings, and/or grooves 48 that weakens the bit body 40. The grooves 48 can be annular, or a plurality of generally parallel grooves or a cris-cross pattern of grooves, similar to a hand grenade. When the opening 46 is to be created, the zones of weakness are broken by the application of fluid pressure, application of heat, application of acid, application of solvent, and/or the application of mechanical force, all as described above.

FIG. 5 shows a rolling cutter rock bit 50 that has usually three shanks 52 with rolling conical cutters 54 journaled thereto. The cutters 54 and/or the shanks 52 are displaced to permit the second drill string to pass therethrough or therepast, the shanks 52 and/or the cutters 54 must be displaced or removed. The displacement or removal of the shanks 52 and/or the cutters 54 can be accomplished by any of the methods and related equipment described previously. For example, as described above, the shanks 52 and/or the cutters 54 can be formed from frangible materials, materials of differing strengths, as well as having selected portions being selectively removable. In one preferred embodiment shown in FIG. 5, the shanks 52 include grooves 58 that are breakable, by any of the means described above. In addition, the shanks 52 can include hinges 60 that permit the shanks 52 and the cutters 54 to be displaced out of the way to form the needed pathway to permit the second drill sting to pass therethrough or therepast.

Figure 6:
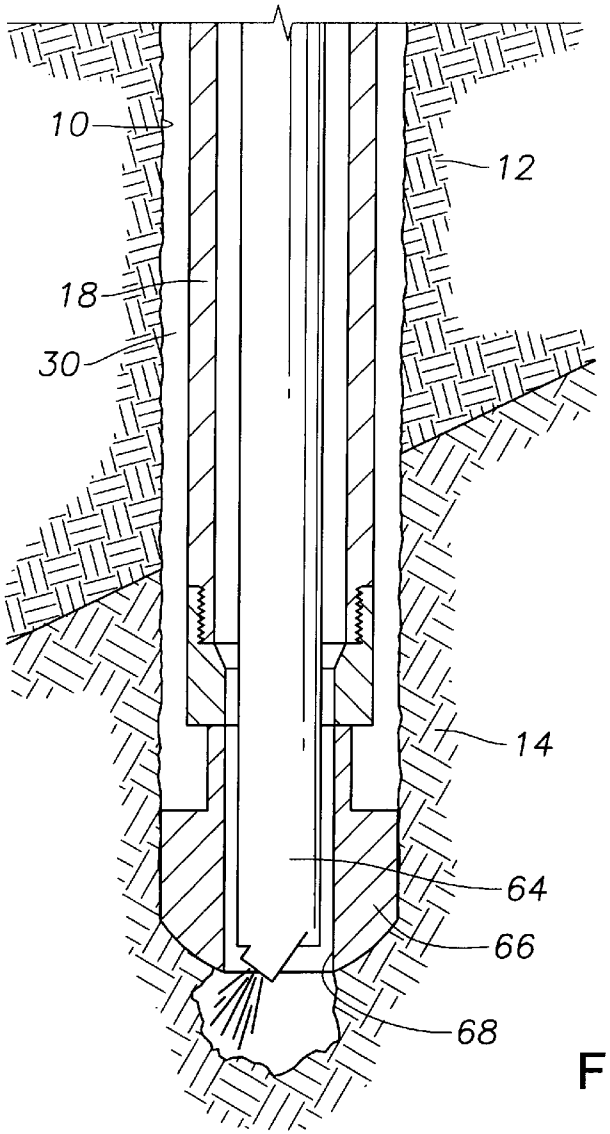
FIG. 6 is an elevational cross-sectioned view of a removal device creating an opening in a drill bit of the present invention in accordance with a preferred method of the present invention.

FIG. 6 illustrates a generic depiction of an alternate preferred method of creating the desired opening in the drill bit to permit the second drill string to pass therethrough or therepast. In FIG. 6 a special cutting tool 64 is lowered into a drill bit 66. As described in relation to the previous embodiments, the drill bit 66 can be formed in any of the above described configurations and/or include any of the above described special features that enable the desired opening to be created and/or the desired portions to be displaced. The cutting tool 64 can emit a spray of fluid of sufficient velocity (with or without entrained abrasives) to erode away a selected portion of the drill bit 66 to form an opening 68. The cutting tool 64 can emit a spray of high temperature gases to thermally cut away a selected portion of the drill bit. The cutting tool 64 can comprise a perforating gun with one or more explosive charges, that when detonated within or adjacent to the drill bit 66, the desired pathway will be created. It should be noted that the cutting tool 64 in its various forms mentioned above, can be used with any of the other preferred drill bits mentioned above, and with or in addition to any of the preferred methods of creating the desired pathway mentioned previously.

As mentioned above, the idea of leaving a drill bit within a wellbore has been something that operators have tried extremely hard to avoid. Further, opening a hole with a drill bit has been unthinkable because drill bit manufactures have strived to make the drill bits as robust, nonbreakable and as hard as possible. However, as can be understood from the above discussions, the methods and related equipment of the present invention can save the operator many thousands of dollars by eliminating the need for the drill pipe to be removed from the wellbore after the high pressure zone has been breached, as well as enabling the drilling operation to continued even if the drill bit becomes stuck in the wellbore.

Whereas the present invention has been described in particular relation to the drawings attached hereto, it should be understood that other and further modifications, apart from those shown or suggested herein, may be made within the scope and spirit of the present invention.

What is claimed is:

1. A drill bit for use in drilling wellbores in subterranean formations, comprising:

a bit body having a face portion, and a shank portion adapted for interconnection to a source of rotary motion; and the face portion provided with means for retaining a selected portion of the face portion in an operable drilling position until application of an acid thereto to release the selected portion from the drill bit.

2. A drill bit for use in drilling wellbores in subterranean formations, comprising:

a bit body having a face portion, and a shank portion adapted for interconnection to a source of rotary motion; and the face portion provided with means for retaining a selected portion of the face portion in an operable drilling position until subjected to heat above a predetermined temperature limit to release the selected portion from the drill bit.

3. A drill bit for use in drilling wellbores in subterranean formations, comprising:

a bit body having a face portion and a shank portion; and the face portion provided with means for retaining a selected portion of the face portion in an operable drilling position until the application of a solvent to release the selected portion of the drill bit.

4. A drill bit for drilling in subterranean formations comprising:

a bit body having a face portion and a shank portion, wherein zones of weakness are formed within the bit body to facilitate removal of a selected portion of the bit body.

5. A drill bit of claim 4 wherein the selected portion is removed along the zones of weakness upon the application of fluid pressure above a predetermined pressure limit.

6. A drill bit of claim 4 wherein the selected portion is removed along the zones of weakness upon the application of acid.

7. A drill bit of claim 4 wherein the selected portion is removed along the zones of weakness upon the application of a solvent.

8. A drill bit of claim 4 wherein the selected portion is removed along the zones of weakness upon the application of heat above a predetermined temperature limit.

9. A drill bit of claim 4 wherein the selected portion is removed along the zones of weakness upon the application of mechanical force above a predetermined force limit.

10. A drill bit of claim 4 wherein the zones of weakness comprise grooves.

11. A drill bit for use in drilling wellbores in subterranean formations, comprising:

a bit body having a cutting portion and a shank portion;

the shank portion including means for interconnection to a first conduit; and the cutting portion being provided with means for permitting a selected portion of the cutting portion to be moved out of a normal position for drilling to a bypass position to permit a second conduit to pass through the drill bit, wherein the means for permitting movement further comprises means for retaining the selected portion of the cutting portion in the normal position until the application of fluid pressure above a predetermined pressure limit.

12. A drill bit for use in drilling wellbores in subterranean formations, comprising:

a bit body having a cutting portion and a shank portion;

the shank portion including means for interconnection to a first conduit; and the cutting portion being provided with means for permitting a selected portion of the cutting portion to be moved out of a normal position for drilling to a bypass position to permit a second conduit to pass through the drill bit, wherein the means for permitting movement further comprises means for retaining the selected portion of the cutting portion in the normal position until the application of acid.

13. A drill bit for use in drilling wellbores in subterranean formations, comprising:

a bit body having a cutting portion and a shank portion;

the shank portion including means for interconnection to a first conduit; and the cutting portion being provided with means for permitting a selected portion of the cutting portion to be moved out of a normal position for drilling to a bypass position to permit a second conduit to pass through the drill bit, wherein the means for permitting movement further comprises means for retaining the selected portion of the cutting portion in the normal position until the application of solvent.

14. A drill bit for use in drilling wellbores in subterranean formations, comprising:

a bit body having a cutting portion and a shank portion;

the shank portion including means for interconnection to a first conduit; and the cutting portion being provided with means for permitting a selected portion of the cutting portion to be moved out of a normal position for drilling to a bypass position to permit a second conduit to pass through the drill bit, wherein the means for permitting movement further comprises means for retaining the selected portion of the cutting portion in the normal position until the application of heat above a predetermined temperature limit.

15. A method of drilling a wellbore within a subterranean formation, comprising:

(a) attaching a drill bit to one end of a first conduit string;

(b) advancing the first conduit string and the drill bit into a subterranean formation to create a wellbore;

(c) creating a longitudinal opening through the drill bit by advancing a rotating milling tool into the drill bit; and (d) advancing a second conduit string through the longitudinal opening and into the subterranean formation.

16. A method of drilling a wellbore within a subterranean formation, comprising:

(a) attaching a drill bit to one end of a first conduit string;

(b) advancing the first conduit string and the drill bit into a subterranean formation to create a wellbore;

(c) creating a longitudinal opening through the drill bit by detonating an explosive charge within or adjacent to the drill bit; and (d) advancing a second conduit string through the longitudinal opening and into the subterranean formation.

17. A method of drilling a wellbore within a subterranean formation, comprising:

(a) attaching a drill bit to one end of a first conduit string;

(b) advancing the first conduit string and the drill bit into a subterranean formation to create a wellbore;

(c) creating a longitudinal opening through the drill bit by applying acid to a selected portion of the drill bit; and (d) advancing a second conduit string through the longitudinal opening and into the subterranean formation.

18. A method of drilling a wellbore within a subterranean formation, comprising:

(a) attaching a drill bit to one end of a first conduit string;

(b) advancing the first conduit string and the drill bit into a subterranean formation to create a wellbore;

(c) creating a longitudinal opening through the drill bit by applying solvent to a selected portion of the drill bit; and (d) advancing a second conduit string through the longitudinal opening and into the subterranean formation.

19. A method of drilling a wellbore within a subterranean formation, comprising:

(a) attaching a drill bit to one end of a first conduit string;

(b) advancing the first conduit string and the drill bit into a subterranean formation to create a wellbore;

(c) creating a longitudinal opening through the drill bit by applying heat to a selected portion of the drill bit; and (d) advancing a second conduit string through the longitudinal opening and into the subterranean formation.

20. A method of drilling a wellbore within a subterranean formation, comprising:

(a) attaching a drill bit to one end of a first conduit string;

(b) advancing the first conduit string and the drill bit into a subterranean formation to create a wellbore;

(c) creating a longitudinal opening through the drill bit by eroding a selected portion of the drill bit by the application pressurized fluid; and (d) advancing a second conduit string through the longitudinal opening and into the subterranean formation.

21. A method of drilling a wellbore within a subterranean formation, comprising:

(a) attaching a drill bit to one end of a first conduit string, the drill bit comprising holding means within the drill bit that retains a selected portion of the drill bit in a normal drilling position, so that when the holding means are released the selected portion is released, thereby creating an opening in the drill bit;

(b) advancing the first conduit string and the drill bit into a subterranean formation to create a wellbore;

(c) creating the opening through the drill bit by applying fluid pressure to release the holding means; and (d) advancing a second conduit string through the longitudinal opening and into the subterranean formation.

22. A method of drilling a wellbore within a subterranean formation, comprising:

(a) attaching a drill bit to one end of a first conduit string, the drill bit comprising holding means within the drill bit that retains a selected portion of the drill bit in a normal drilling position, so that when the holding means are released the selected portion is released, thereby creating an opening in the drill bit;

(b) advancing the first conduit string and the drill bit into a subterranean formation to create a wellbore;

(c) creating the opening through the drill bit by applying acid to release the holding means; and (d) advancing a second conduit string through the longitudinal opening and into the subterranean formation.

23. A method of drilling a wellbore within a subterranean formation, comprising:

(a) attaching a drill bit to one end of a first conduit string, the drill bit comprising holding means within the drill bit that retains a selected portion of the drill bit in a normal drilling position, so that when the holding means are released the selected portion is released, thereby creating an opening in the drill bit;

(b) advancing the first conduit string and the drill bit into a subterranean formation to create a wellbore;

(c) creating the opening through the drill bit by applying solvent to release the holding means; and (d) advancing a second conduit string through the longitudinal opening and into the subterranean formation.

24. A method of drilling a wellbore within a subterranean formation, comprising:

(a) attaching a drill bit to one end of a first conduit string, the drill bit comprising holding means within the drill bit that retains a selected portion of the drill bit in a normal drilling position, so that when the holding means are released the selected portion is released, thereby creating an opening in the drill bit;

(b) advancing the first conduit string and the drill bit into a subterranean formation to create a wellbore;

(c) creating the opening through the drill bit by applying heat to release the holding means; and (d) advancing a second conduit string through the longitudinal opening and into the subterranean formation.

25. A method of drilling a wellbore within a subterranean formation, comprising:

(a) attaching a drill bit to one end of a first conduit string, the drill bit comprising holding means within the drill bit that retains a selected portion of the drill bit in a normal drilling position, so that when the holding means are released the selected portion is released, thereby creating an opening in the drill bit;

(b) advancing the first conduit string and the drill bit into a subterranean formation to create a wellbore;

(c) creating the opening through the drill bit by eroding the holding means by the application of pressurized fluid to release the holding means; and (d) advancing a second conduit string through the longitudinal opening and into the subterranean formation.

26. A drill bit for drilling in subterranean formations comprising:

a bit body having a face portion and a shank portion, the bit body being made of a first material and the face portion being made of a second material, the first material being relatively hard compared to the second material to facilitate removal of the face portion of the bit body.

27. The drill bit of claim 26, wherein the first material comprises steel and wherein the second material comprises at least one of bronze, brass, ceramic, and aluminum.

* * * * *